US006786214B2

(12) United States Patent
Andrews

(10) Patent No.: US 6,786,214 B2
(45) Date of Patent: Sep. 7, 2004

(54) BOW ACTUATING SYSTEM

(76) Inventor: Albert A. Andrews, 423 Old Tasso Place Rd., Cleveland, TN (US) 37312

( * ) Notice: Subject to any disclaimer, the term of this patent is extended or adjusted under 35 U.S.C. 154(b) by 0 days.

(21) Appl. No.: 10/712,193

(22) Filed: Nov. 13, 2003

(65) Prior Publication Data

US 2004/0094139 A1 May 20, 2004

Related U.S. Application Data

(63) Continuation of application No. 10/256,623, filed on Sep. 27, 2002, now Pat. No. 6,712,057.
(60) Provisional application No. 60/425,900, filed on Nov. 13, 2002.

(51) Int. Cl.[7] ..... F41B 5/00
(52) U.S. Cl. ..... 124/23.1; 124/25.6
(58) Field of Search ..... 124/23.1, 25.6, 124/86, 88

(56) References Cited

U.S. PATENT DOCUMENTS 3,628,519 A * 12/1971 Hofmeister ..... 124/23.1
3,957,027 A * 5/1976 Drake ..... 124/23.1
4,955,354 A * 9/1990 Bozek ..... 124/23.1
5,464,001 A * 11/1995 Peck ..... 124/25.6
5,706,794 A * 1/1998 Neal ..... 124/25.6
5,816,233 A 10/1998 Andrews
5,881,704 A 3/1999 Andrews
6,019,097 A * 2/2000 Cox et al. ..... 124/23.1
6,055,974 A * 5/2000 Dieziger ..... 124/23.1
6,082,346 A 7/2000 Andrews et al.
6,250,293 B1 6/2001 Andrews
6,253,752 B1 * 7/2001 Cox et al. ..... 124/23.1
6,360,734 B1 3/2002 Andrews
6,367,464 B1 * 4/2002 Bronnert ..... 124/23.1

* cited by examiner

*Primary Examiner*—John A. Ricci
(74) *Attorney, Agent, or Firm*—Clark Hill PLC

(57) ABSTRACT

An archery bow comprising a riser extending between opposing first and second ends, with a limb coupled to each end. Each limb has a first end for connecting to the riser and a second distal end. An axle pivotally connects at least one of the limbs to one end of the riser. An actuator operatively couples between at least one of the limbs and the riser adjacent the axle for supporting the limbs about the riser. The actuator includes a resilient member for storing energy as the bow is drawn, and releasing energy as the bow is released. The resilient member pivotally attaches to the riser and the limb, elongating or compressing to dynamically change the angle between the riser and the limb while the bow is in use. After the shot, the resilient member acts as a shock absorber to damp the vibration of the bow.

20 Claims, 5 Drawing Sheets

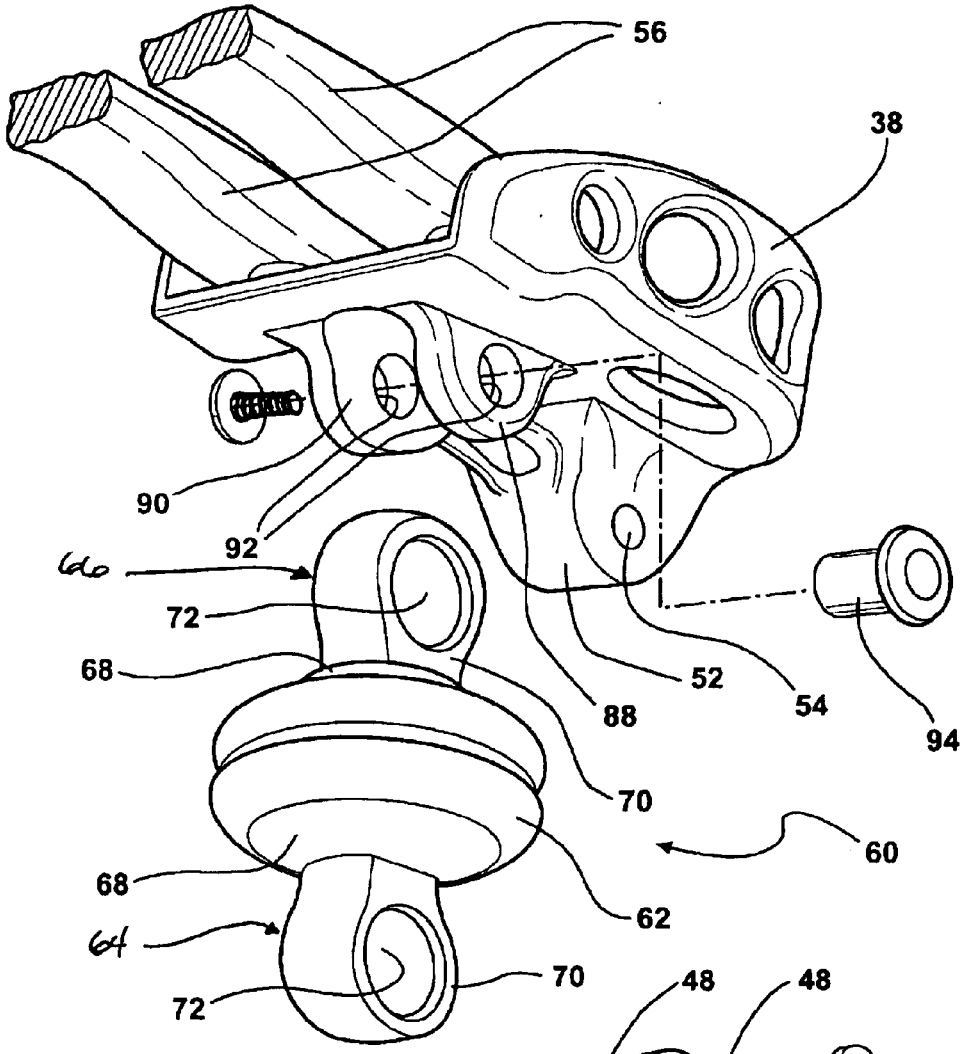
FIG - 4
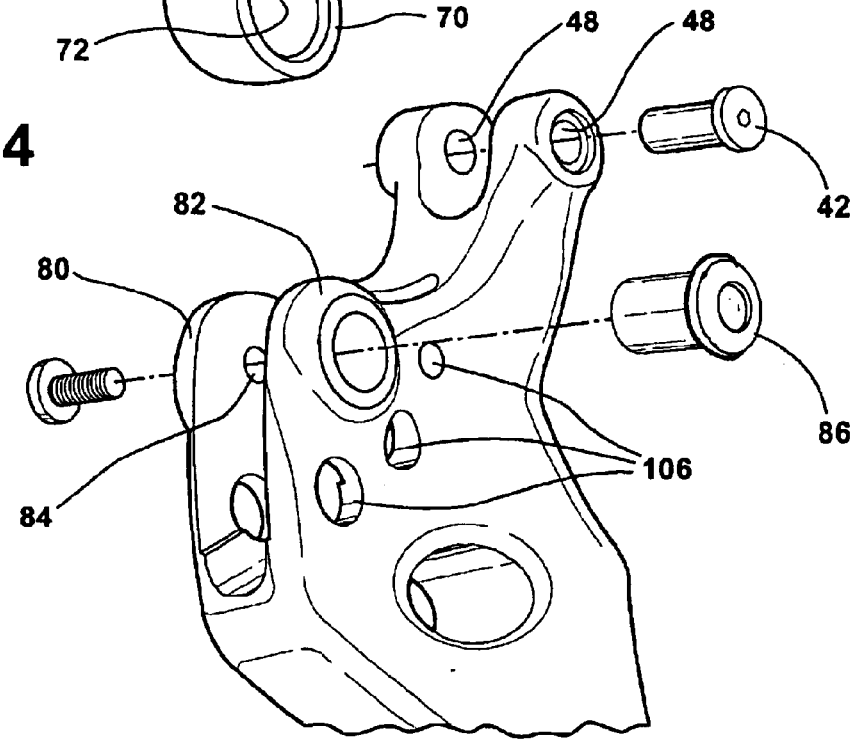

BOW ACTUATING SYSTEM

RELATED APPLICATIONS

This application is a continuation in part of U.S. patent application Ser. No. 10/256,623, filed on Sep. 27, 2002, now U.S. Pat. No. 6,712,057, and further claims the benefit and priority under 35 U.S.C. § 119(e) of U.S. Provisional Application No. 60/425,900, filed on Nov. 13, 2002.

BACKGROUND OF THE INVENTION

1. Field of the Invention

The present invention relates to archery bow assemblies, and more particularly, to an actuating system for dynamically reducing the draw weight of a bow and damping extraneous motions of the bow following a shot.

2. Description of the Related Art

Archery bows typically include a riser defining a handle for holding the bow and a pair of flexible limbs extending from opposite ends of the riser to distal ends. A wheel or cam is commonly rotatably attached to the distal end of each limb and a bowstring and harness system is wound between the wheels or cams of the limbs. The limbs are typically flexible such that as a bow is drawn, potential energy is typically stored within the limbs themselves. When the bowstring is released, the potential energy is converted to kinetic energy for propelling the arrow as the limbs return to a rest position.

The bowstring and harness system is loaded under high tension, thereby defining a draw weight as the force required to pull the bowstring to its full position. It is common to connect the limbs of the bow to the riser with a connector which extends through the limb and is threaded into the riser. As the bow is drawn, the limbs flex and exert a significant shearing force, typically on the connector. The force imparted to an arrow upon release of the bowstring, or the bow thrust, is directly proportional to the draw weight. While it is desirable to provide an increased bow thrust for propelling the arrow with increased speed and force, the corresponding increase in the draw weight will increase the shearing force on the connector and vibration in the bow. Therefore, it is desirable to provide a bow actuating system which maximizes the bow thrust while decreasing the draw weight by supporting at least some of the force exerted by the limbs.

The draw weight of the bow is typically changed by attaching a different length string between the wheels or cams, by changing the size of the limbs, or by changing the angle or orientation of the limbs relative to the riser. The connector may be loosened to change the orientation of the limbs relative to the riser and slightly adjust the draw weight of the bow. However, prior art systems providing orientation adjustment by loosening the connector require manual adjustment, which can only occur when the bow is not is use. Thus, it is also desirable to provide a bow actuating system which dynamically changes the orientation of the limbs during use of the bow to minimize the draw weight.

The accuracy of an archery bow largely depends on elimination of extraneous motions of the bow. As the bowstring is released, the riser and the limbs vibrate causing the bowstring to oscillate as the arrow leaves the bow. The oscillation affects the trajectory of the arrow, greatly impacting an archer's accuracy, while also causing unwanted noise and hand shock. Therefore, it is further desirable to provide a bow actuating system which acts as a shock absorber after a shot, thereby reducing vibration of the bow.

SUMMARY OF THE INVENTION

Accordingly, the invention provides an archery bow comprising a riser extending between opposing first and second ends. A limb is coupled to each end of the riser. Each limb has a first end for connecting to the riser and a second distal end. An axle pivotally connects at least one of the limbs to one end of the riser. An actuator is operatively coupled between at least one of the limbs and the riser adjacent the axle for supporting the limbs about the riser, and thus for supporting the forces exerted by the limb. The actuator includes a resilient member for storing energy as the bow is drawn, and releasing energy as the bow is released. The resilient member is pivotally attached to both the riser and the limb, elongating or compressing to dynamically change the angle between the riser and the limb while the bow is in use to minimize the draw weight. Because of the three-pivot system, the force exerted by the limbs impacts the actuator at approximately a 90 degree angle throughout the shot, thereby maximizing bow thrust. After the shot, the resilient member acts as a shock absorber to reduce the vibration of the bow.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is a fragmentary exploded view of the archery bow assembly as shown in FIG. 2;

DETAILED DESCRIPTION OF THE PREFERRED EMBODIMENT

Figure 1:
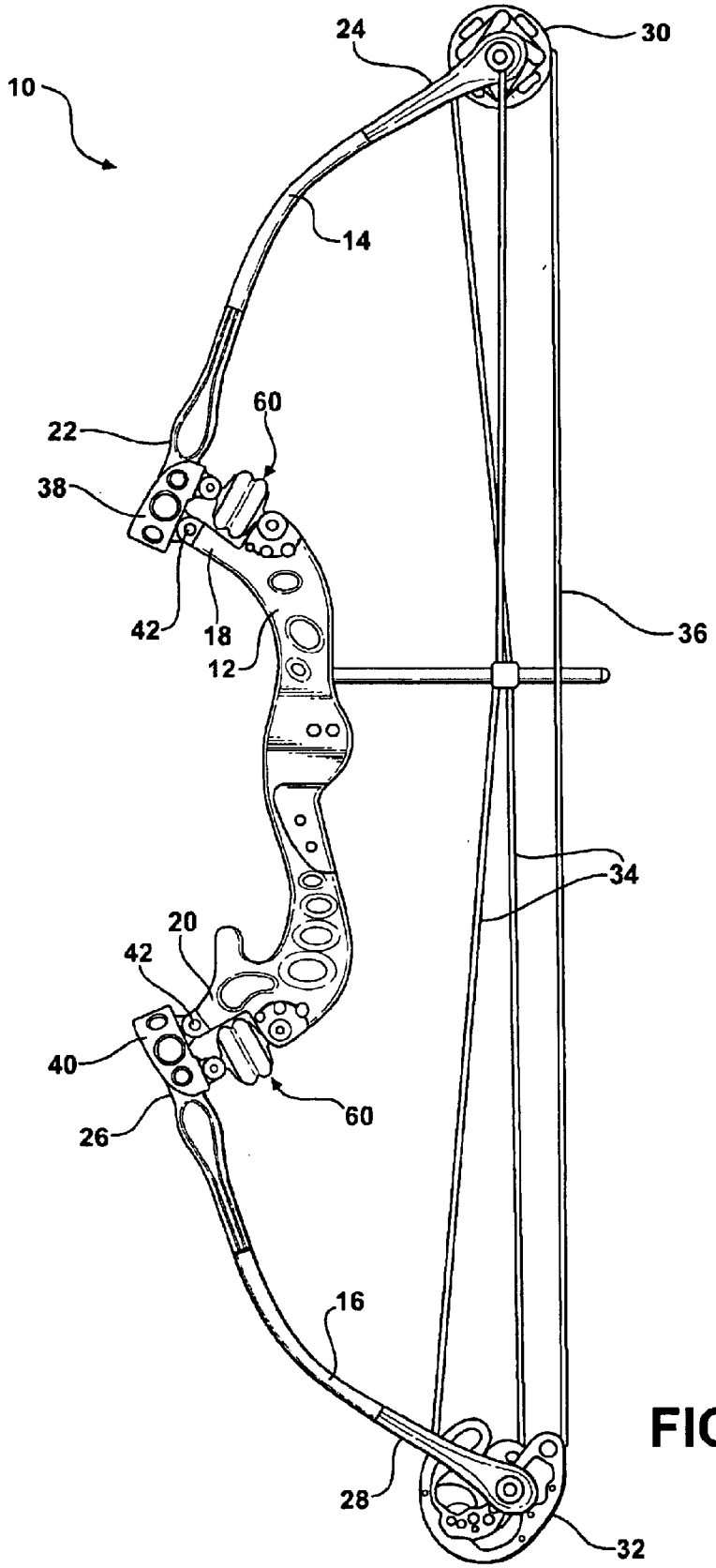
FIG. 1 is a side view of an archery bow assembly in a braced position according to one aspect of the present invention, showing an actuator connected between a limb and a riser of the archery bow in compression.

Referring to the drawings, FIG. 1 illustrates a compound archery bow 10 having a riser 12 with first and second limbs 14, 16 extending from opposing ends 18, 20 of the riser 12. The first limb 14 has a first end 22 connected to the end 18 of the riser 12 and a second distal end 24. Similarly, the second limb 16 has a first end 26 connected to the opposite end 20 of the riser 12 and a second distal end 28. A wheel or cam 30, 32 is rotatably attached to each distal end 24, 28 of the limbs 14, 16. Additionally, a harness or cable system 34 and a bowstring 36 are wound around and between each wheel or cam 30, 32 and pulled in tension by the limbs 14, 16.

The bow 10 further includes a pair of limb pockets 38, 40 for pivotally attaching the respective limbs 14, 16 to the opposing ends 18, 20 of the riser 12. A pocket axle 42 pivotally couples each of the respective limb pockets 38, 40 to the opposing ends 18, 20. Specifically, the ends 18, 20 of the risers 12 each include an extended pair of spaced apart fingers 44, 46 (as shown in FIGS. 2 through 7) each having a bore 48 therethrough for receiving the pocket axle 42. The limb pockets 38, 40 each include a base 50 having an axle post 52 extending therefrom with a through bore 54. The axle post 52 seats between the fingers 44, 46 and the bores 48, 54 align axially to receive the pocket axle 42 therethrough, thus pivotally securing the limb pocket 38, 40 to the riser 12.

Figure 2:
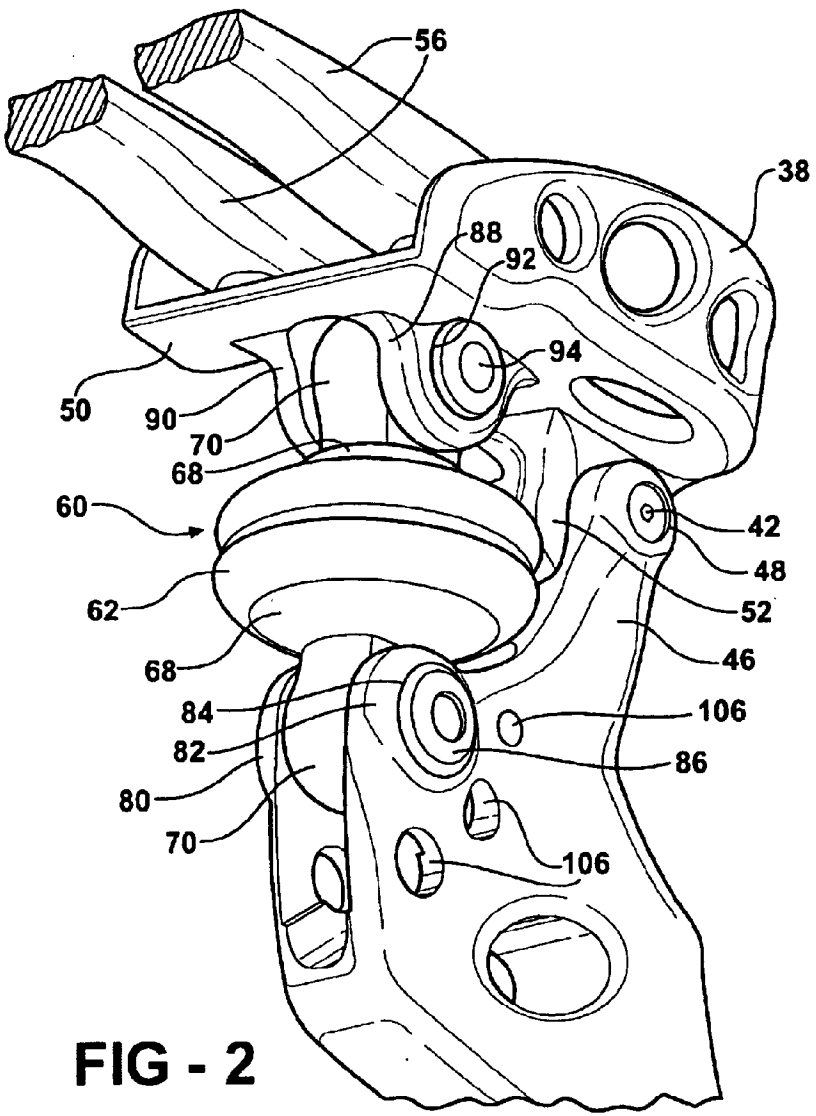
FIG. 2 is an enlarged perspective view of a first embodiment of the actuator connected between the limb and the riser.
Figure 5:
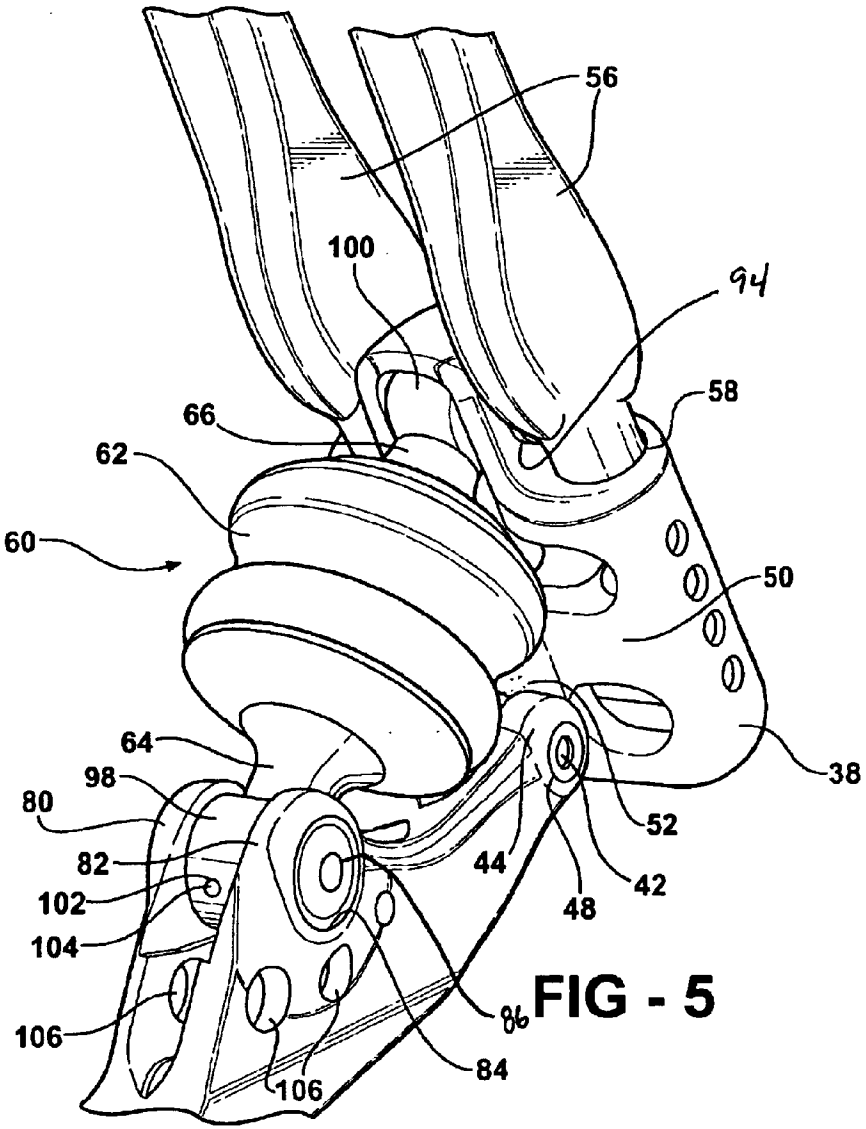
FIG. 5 is an enlarged perspective view of a second embodiment of the actuator connected between the limb and the riser.

Each limb 14, 16 may be a single unitary member, two spaced apart members, or a split limb, as shown in FIG. 2, with a pair of substantially separate and parallel spaced apart limb posts 56. When limb posts 56 are utilized, the limb pocket 38 may include spaced apart tunnels 58, as shown in FIG. 5, for receiving and mounting the limb posts 56 to the limb pocket 38 along the longitudinal length thereof, as best shown in FIG. 4. The limb posts 56 may be secured to the limb pocket 38 by any suitable means.

In the preferred embodiment, an actuator 60 pivotally attaches between each limb pocket 38, 40 and the riser end 18, 20 adjacent thereto. However, the actuator 60 could also attach directly between each limb 14, 16 and the adjacent riser end 18, 20. Pivotal attachment is preferably achieved as described below. However, pivotal attachment may occur using a machined cylinder, a swiveling bolt or head, a ball and socket joint, or a pivoting cam block, or any other means of pivotal attachment known in the art.

Figure 3:
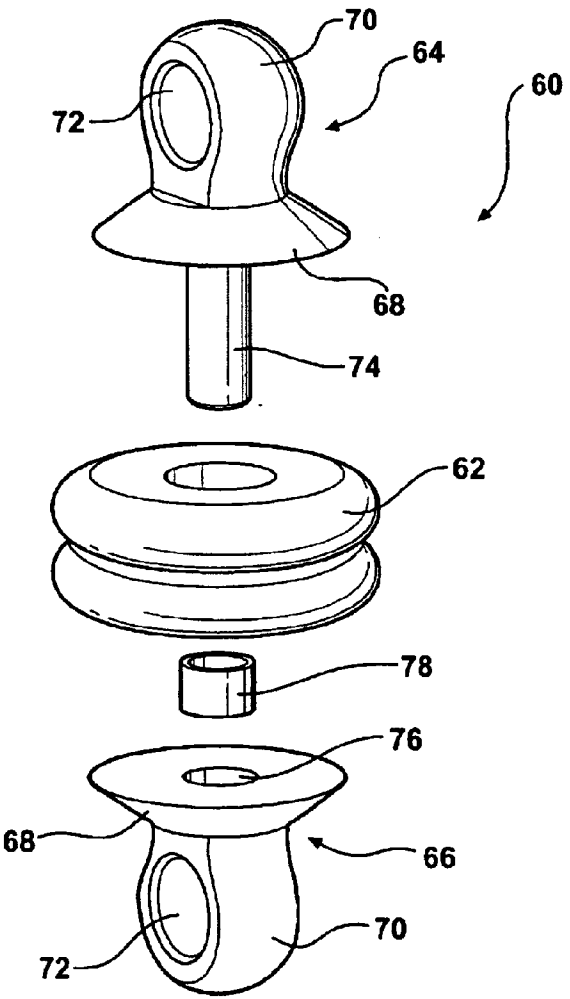
FIG. 3 is an enlarged exploded view of the actuator shown in FIG. 2.

FIGS. 2, 3 and 4 depict a first embodiment of the actuator 60 connected between the limb 14 and riser 12 in more detail. Only one actuator 60 between the limb 14 and riser 12 will be described in detail. However, it should be appreciated that the actuator 60 between the opposite limb 16 and riser 12 includes the same elements and functions. The actuator 60 comprises a resilient member 62 and first and second connectors 64, 66. The resilient member 62 is preferably an elastomeric material such as urethane or polyurethane in any durometer, for example, ranging from 0 to 100 on the Shore 00 scale, 0 to 100 on the Shore A scale, and 0 to 100 on the Shore D scale. Two or more materials having different durometers may also be combined to form the actuator 60 to provide specific energy absorption properties. For example, the actuator 60 may partially comprise a material of durometer 90 for maximizing energy storage and partially a material of durometer 70 for providing increased damping capabilities. The resilient member 62 may also be comprised of any type of elastomeric material such as plastic or certain types of metal. Additionally, the resilient member 62 may be a spring, a gas cylinder, a cantilever arm, or any other type of expandable and compressible device.

In the first embodiment, each connector 64, 66 comprises an attachment portion 68 and a pivot post 70 including a hole 72 therethrough. Additionally, the first connector 64 includes a connector pin 74, while the second connector 66 includes a recess 76 for receiving the connector pin 74. The connector pin 74 extends from the first connector 64 through the resilient member 62 to seat within the recess 76 to secure the connectors 64, 66 to the resilient member 62. A bushing 78 may be used to secure the connection between the connectors 64, 66. The connector pin 74 can extend through the resilient member 62 in a number of different ways. By way of example, the resilient member 62 may be formed with a hole to receive the connector pin 74, or the connector pin 74 may be integrally molded with the resilient member 62. The connectors 64, 66 may also be bonded directly to the resilient member 62 for additional connection security, either using adhesive or heat bonding, or any other bonding process.

Referring to FIG. 4, the riser 12 includes spaced apart flanges 80, 82 each having a hole 84 therethrough, the axis of which is parallel to the axis of the pocket axle 42. The pivot post 70 of the first connector 64 seats between the flanges 80, 82 such that the holes 72, 84 align axially. A riser axle 86 extends through the holes 72, 84 allowing the first connector 64 to rotate thereabout to pivotally secure the actuator 60 to the riser 12.

The limb pocket 38 includes a pair of spaced apart support posts 88, 90 extending longitudinally from the base 50. Each support post 88, 90 includes a bore 92 therethrough, the axis of which is parallel to the axis of the pocket axle 42. Similar to the connection described previously, the pivot post 70 of the second connector 66 seats between the support posts 88, 90 such that the bores 92 and the hole 72 align axially. A limb axle 94 extends through the bores 92 and the hole 72 allowing the second connector 66 to rotate thereabout to pivotally secure the actuator 60 to the limb 14. While the invention as described contemplates attaching the first connector 64 to the riser 12 and the second connector 66 to the limb 14, the inventive concept would not be changed by connecting the first connector 64 to the limb 14 and the second connector 66 to the riser 12.

Figure 6:
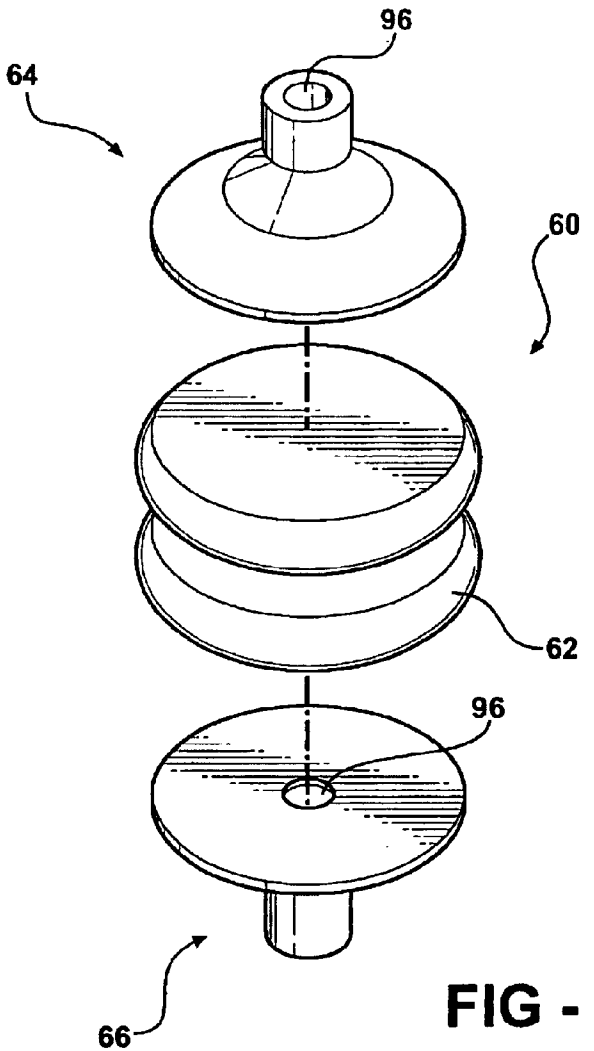
FIG. 6 is an enlarged exploded view of the actuator shown in FIG. 4.

FIGS. 5 and 6 illustrate a second embodiment of the actuator 60 connected between the limb 14 and riser 12 in more detail. Again, only one actuator 60 between the limb 14 and riser 12 will be described in detail. However, it should be appreciated that the actuator 60 between the opposite limb 16 and riser 12 includes the same elements and functions. The actuator 60 comprises a resilient member 62 and first and second connectors 64, 66 as in the first embodiment. In the second embodiment, each connector 64, 66 includes a recessed threaded bore 96. A cylindrical riser retainer 98, shown best in FIG. 5, seats between the holes 84 in the flanges 80, 82 of the riser 12. A riser axle 86 extends through the retainer 98, allowing the retainer 98 to rotate thereabout. Similarly, a cylindrical limb retainer 100 seats between the bores 92 in the support posts 88, 90 of the limb 14, and a limb axle 94 extends through the retainer 100, allowing the retainer 100 to rotate thereabout. Each retainer 98, 100 includes a longitudinal bore 102 for receiving a threaded retainer pin 104. The retainer pin 104 extends through the retainer 98, 100 and continues through the recessed threaded bore 96 of one of the connectors 64, 66, thereby securing one connector 64, 66 to the riser 12 and the other connector 64, 66 to the limb 14.

In each of the first and second embodiments, the actuator 60 connects between the riser 12 and the limb 14 in compression. As the bow 10 is drawn, the actuator 60 supports the limb 14, allowing the limb 14 to flex about the riser 12. The force exerted by the limb 14 compresses the resilient member 62 of the actuator 60 further, thereby storing at least a portion of the energy which is usually stored in the limb 14. The actuator 60 receives at least part of the force and perhaps all of it, though the limb 14 may still store energy. In this manner, the actuator 60 relieves the shearing forces typically present on the connector between the riser 12 and the limbs 14, 16. As the pocket axle 42 pivots, the riser axle 86 and the limb axle 94 also pivot, moving the actuator 60 therewith, thereby minimizing draw weight by dynamically changing the orientation of the limb 14 relative to the riser 12 while the bow 10 is in use. Preferably, the axles 42, 86, 94 are arranged such that the force exerted by the limb 14 always impacts the actuator 60 at approximately a 90 degree angle to maximize bow thrust.

More specifically, as the limb 14 flexes about the riser 12 and pivots about the riser axle 86, the pocket axle 42 and limb axle 94 which pivotally couple the first connector 64 and second connector 66 to the riser 12 and limb 14, respectively, allow the actuator 60 to articulate and maintain its angular position, approximately a 90 degree angle, relative to the limb 14. Maintaining the angular position of the actuator 60 relative to the limb 14 maximizes the amount of energy stored in actuator 60 and ultimately released from the bow 10 into the arrow.

As the bowstring 36 is released, the resilient member 62 releases the stored energy to assist in propelling an arrow forward. The bow 10 returns to a braced position as shown in FIG. 1, with the resilient member 62 returning to an initially compressed position. As this occurs, the resilient member 62, being elastomeric, absorbs much of the vibration from the bowstring 36, acting as a shock absorber. The resilient member 62 damps the vibration by elongating and compressing until the initial compressed position is once again attained.

Figure 7:
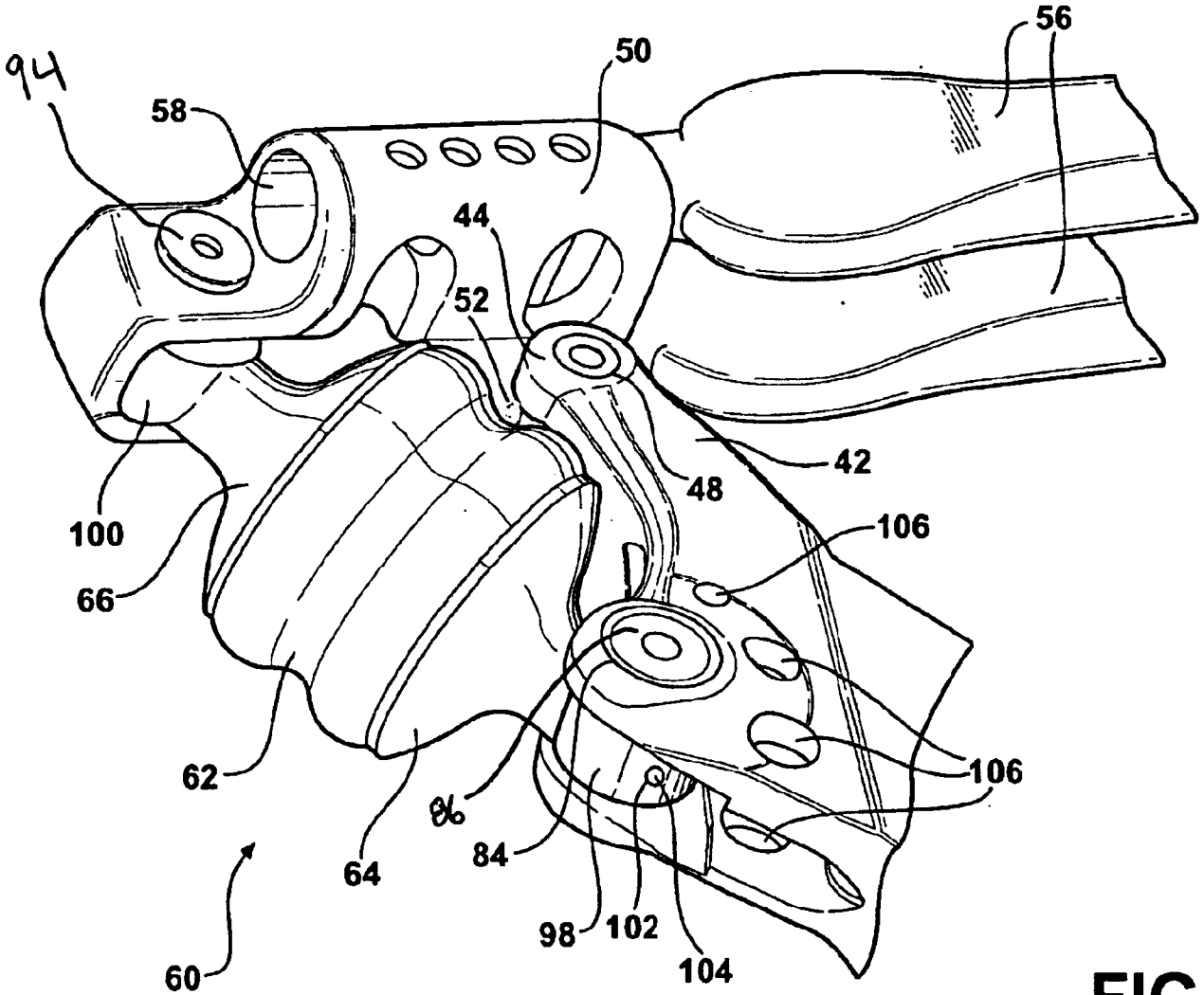
FIG. 7 is an enlarged perspective view of another aspect of the present invention, showing the actuator of FIGS. 4 and 5 connected between the limb and the riser in tension.

FIG. 7 shows an alternate configuration of the bow 10 of the present invention, wherein the actuator 60 connects between the riser 12 and the limb 14 in tension. While FIG. 7 depicts the second embodiment of the actuator 60, either embodiment may be utilized in this tension arrangement. In this configuration, the force exerted by the limb 14 as the bow 10 travels from the braced position to the drawn position further elongates the resilient member 62. When the bowstring 36 is released, the resilient member 62 releases the stored energy and the bow 10 returns to the braced position. The resilient member 62 damps the vibration from the bowstring 36 by compressing and elongating until an initial elongated position is once again attained.

In each configuration and embodiment of the present invention, the riser 12 includes a recessed end profile 110 defining a pocket between the riser 12 and limb 14 for receiving and allowing the actuator 60 to pivot freely between the riser 12 and the limb 14 without contacting either. Specifically, the riser end 18 is fabricated to provide at least $1/16^{th}$ of an inch of clearance between the limb pocket 38 and the riser 12. The clearance may also be substantially larger. For instance, utilizing the actuator 60 of the preferred embodiment, the clearance may reach 5 inches or more. Additionally, undercuts 106 may be provided in the riser 12 to reduce the mass of the bow 10 without changing the inventive concept.

It should be appreciated by one skilled in the art that the actuator 60 may be used on a recurve bow, compound bow or cross bow without changing the inventive concept. Additionally, the actuator 60 may be coupled between only one of the limbs 14, 16 and the riser 12 or between both limbs 14, 16 and the riser 12. That is, one of the limbs 14, 16 may be fixedly attached to one end 18, 20 of the riser 12 and the other limb 14, 16 pivotally attached to the opposite end 18, 20 of the riser 12 with the actuator 60 extending therebetween. Furthermore, a combination of actuators 60 can be used in series or in parallel. Finally, it should also be appreciated that the support posts 88, 90 may attach to either the limb pocket 38 as shown, or the limb 14 itself without varying from the scope of the invention or function of the actuator 60. That is, the actuator 60 may be attached between the riser 12 and the limb pocket 38, or the riser 12 and the limb 14 itself.

The invention has been described in an illustrative manner, and it is to be understood that the terminology used is intended to be in the nature of words of description rather than of limitation. Many modifications of the present invention are possible in light of the above teachings. It is, therefore, to be understood that within the scope of the appended claims, the invention may be practiced in a substantially equivalent way other than as specifically described.

What is claimed is:

1. An archery bow comprising:

a riser extending between opposing first and second ends;

a limb coupled to each end of said riser;

an axle pivotally connecting at least one of said limbs to one end of said riser; and an actuator operatively coupled between at least one of said limbs and said riser adjacent said axle for supporting said limb about said riser, said actuator including a resilient member for storing and releasing energy as said limbs are flexed about said riser.

2. An archery bow as set forth in claim 1 wherein said resilient member compresses and stores energy as said limbs are flexed from a braced position to a drawn position and elongates and releases said stored energy as said limbs return from said drawn position to said braced position.

3. An archery bow as set forth in claim 1 wherein said resilient member elongates and stores energy as said limbs are flexed from a braced position to a drawn position and compresses and releases said stored energy as said limbs return from said drawn position to said braced position.

4. An archery bow as set forth in claim 1 wherein said actuator further includes a first connector attached to said resilient member and pivotally coupled to said riser, and a second connector attached to said resilient member and pivotally coupled to said limb.

5. An archery bow as set forth in claim 4 wherein said riser includes a pair of spaced apart riser flanges having axially aligned holes for rotatably supporting said first connector.

6. An archery bow as set forth in claim 5 wherein said limb comprises a limb pocket and an extending arm, said limb pocket having a base for fixedly supporting said extending arm and an axle post for receiving said axle and pivotally attaching said limb to said riser.

7. An archery bow as set forth in claim 6 wherein said limb pocket includes a pair of spaced apart support posts extending from said base each having an axially aligned holes therethrough for rotatably supporting said second connector.

8. An archery bow as set forth in claim 7 wherein at least one of said connectors includes a pivot post having an axial bore therethrough, said pivot post seating between one of said riser flanges of said riser and said support posts of said limb such that said axial bore and said axially aligned holes are aligned.

9. An archery bow as set forth in claim 8 further including an axle extending through said axially aligned holes and said axial bore to secure said at least one of said connectors and said one of said riser and said limb such that as said pivot post rotates about said retaining pin, said actuator rotates about said one of said riser and said limb.

10. An archery bow as set forth in claim 9 wherein one of said first and second connectors includes a connector pin extending through said resilient member and seated within the other of said first and second connectors to secure said first and second connectors to said resilient member.

11. An archery bow as set forth in claim 7 wherein at least one of said connectors includes a longitudinally recessed threaded bore, said threaded bore seating between one of said riser flanges of said riser and said support posts of said limb.

12. An archery bow as set forth in claim 11 further including a retainer extending through said axially aligned holes of said one of said riser flanges of said riser and said support posts of said limb for rotatably supporting said at least one of said connectors.

13. An archery bow as set forth in claim 12 further including a retainer axle extending through said retainer for allowing said retainer to rotate within said thereabout.

14. An archery bow as set forth in claim 13 wherein said retainer includes an longitudinal bore for receiving said at least one of said connectors such that as said retainer rotates about said retainer axle, said actuator rotates about said one of said riser and said limb.

15. An archery bow as set forth in claim 14 wherein said at least one of said connectors includes a longitudinally recessed threaded bore, said threaded bore extending through said aperture to align said at least one of said connectors and said support rod.

16. An archery bow as set forth in claim 15 further including a retainer pin extending longitudinally through said longitudinal bore and said threaded bore for securing said at least one of said connectors to said retainer.

17. An archery bow as set forth in claim 1 wherein said resilient member absorbs excess energy as said limbs return to a braced position from a drawn position after a shot to minimize oscillation of said limbs and said riser.

18. An archery bow comprising:

a riser extending between opposing first and second ends;

a limb coupled to each end of said riser;

an axle pivotally connecting at least one of said limbs to one end of said riser; and an actuator operatively coupled between at least one of said limbs and said riser for supporting said limb about said riser, said actuator including a first connector pivotally coupled to said riser and a second connector pivotally coupled to said limb for maintaining the angular postion of said actuator relative to said limb as said limb is flexed about said riser.

19. An archery bow as set forth in claim 18 wherein said actuator includes a resilient member extending between said first and second connector for storing and releasing energy as said limb is flexed about said riser.

20. An archery bow as set forth in claim 19 wherein said riser includes a recessed end profile for defining a pocket between said riser and said limb for receiving and allowing said actuator to articulate and maintain its angular position relative to said limb as said limb pivots about said riser.

* * * * *